United States Patent [19]

Kobayashi et al.

[11] Patent Number: 5,069,644

[45] Date of Patent: Dec. 3, 1991

[54] COWLING AND AIR INLET DEVICE FOR OUTBOARD MOTOR

[75] Inventors: Seiji Kobayashi; Masaharu Miyazaki, both of Hamamatsu, Japan

[73] Assignee: Sanshin Kogyo Kabushiki Kaisha, Hamamatsu, Japan

[21] Appl. No.: 444,084

[22] Filed: Nov. 30, 1989

[30] Foreign Application Priority Data

Nov. 30, 1988 [JP] Japan ..... 63-301054

[51] Int. Cl.[5] ..... B63H 21/24

[52] U.S. Cl. ..... 440/77; 123/195 P

[58] Field of Search ..... 440/76, 77, 88; 123/195 C, 195 P

[56] References Cited

U.S. PATENT DOCUMENTS 4,403,971 9/1983 Kobayashi et al. ..... 440/88
4,571,193 2/1986 Takada et al. ..... 440/77
4,723,927 2/1988 Walsh et al. ..... 440/77
4,734,070 3/1988 Mondek ..... 440/77
4,869,693 9/1989 Curtis et al. ..... 440/77

*Primary Examiner*—Jesûs D. Sotelo
*Attorney, Agent, or Firm*—Ernest A. Beutler

[57] ABSTRACT

Two embodiments of a cowling and air inlet device for a power head of an outboard motor are disclosed and described which include an air inlet open only on one or both sides of the cowling so as to insure adequate air induction to the engine but to prevent water from entering the interior of the cowling and the engine induction system. The air inlet is formed in a upper rear surface of the cowling and has formed therein an air intake duct for supplying air to the engine induction system. A cover is positioned above the air intake duct to cooperate in defining a flow path for air through the air inlet to the air intake duct and to prevent foreign objects from falling in the air intake duct.

11 Claims, 4 Drawing Sheets

COWLING AND AIR INLET DEVICE FOR OUTBOARD MOTOR

BACKGROUND OF THE INVENTION

This invention relates to a cowling for an outboard motor, and more particularly to an improved protective cowling and air inlet device for the power head of an outboard motor.

It is well known with outboard motors that the powering internal combustion engine is normally enclosed within a protective cowling so as to provide protection for the internal combustion engine and a better appearance for the outboard motor. The protective cowling defines a cavity in which the internal combustion engine is contained. It is also well known that the engine must be supplied with copious amounts of air for the engine induction system. Conventionally, the protective cowling includes an air inlet positioned in the upper rear portion thereof. This air inlet generally has an upwardly and rearwardly facing opening and may have sidewardly facing openings as well to permit air to flow into the cavity of the protective cowling for supply to the engine induction system. See for example U.S. Pat. No. 4,571,193. Typically a further cowling member is provided that extends across the rearwardly facing this air inlet opening so as to prevent foreign objects from falling into the inlet and which defines with the remaining portion of the cowling the rearwardly facing air inlet opening.

Air inlets with rearwardly facing openings are normally incorporated so that under normal operating conditions water will not enter into the interior of the cowling or into the engine induction system. Under extreme conditions, however, such an arrangement can permit water to enter into the interior of the protective cowling and damage the engine and the electrical parts of the outboard motor or enter the induction system of the engine. Such an air inlet can be especially susceptible to the entry of water when the speed of the marine vessel is quickly reduced during operation so that a wave strikes the rear of the marine vessel and outboard motor. This arrangement also makes it possible for rain to enter the air inlet when the outboard motor is tilted up.

It is, therefore, a principal object of this invention to provide an improved cowling and air inlet device for the powerhead of an outboard motor which will insure that water cannot enter the engine induction system or the cavity which surrounds the engine.

SUMMARY OF THE INVENTION

A cowling and air inlet device is provided for the powerhead of an outboard motor having an internal combustion engine including an induction system. The cowling and air inlet device comprises air inlet means for inducting air from the atmosphere formed in an upper rear surface of the cowling. The air inlet means is open on at least one side of the cowling and preferably on both sides of the cowling but not on the rear surface of the cowling. The invention further includes air intake means formed within the air inlet means for supplying air to the induction system. A cover is provided which is secured to the cowling for covering the air intake means. The cover is positioned upward of the air intake means and spaced therefrom to cooperate in defining flow path for air through the air inlet means to the air intake means. In a second embodiment the cover is part of the body of the cowling.

DETAILED DESCRIPTION OF THE PREFERRED EMBODIMENTS

Figure 1:
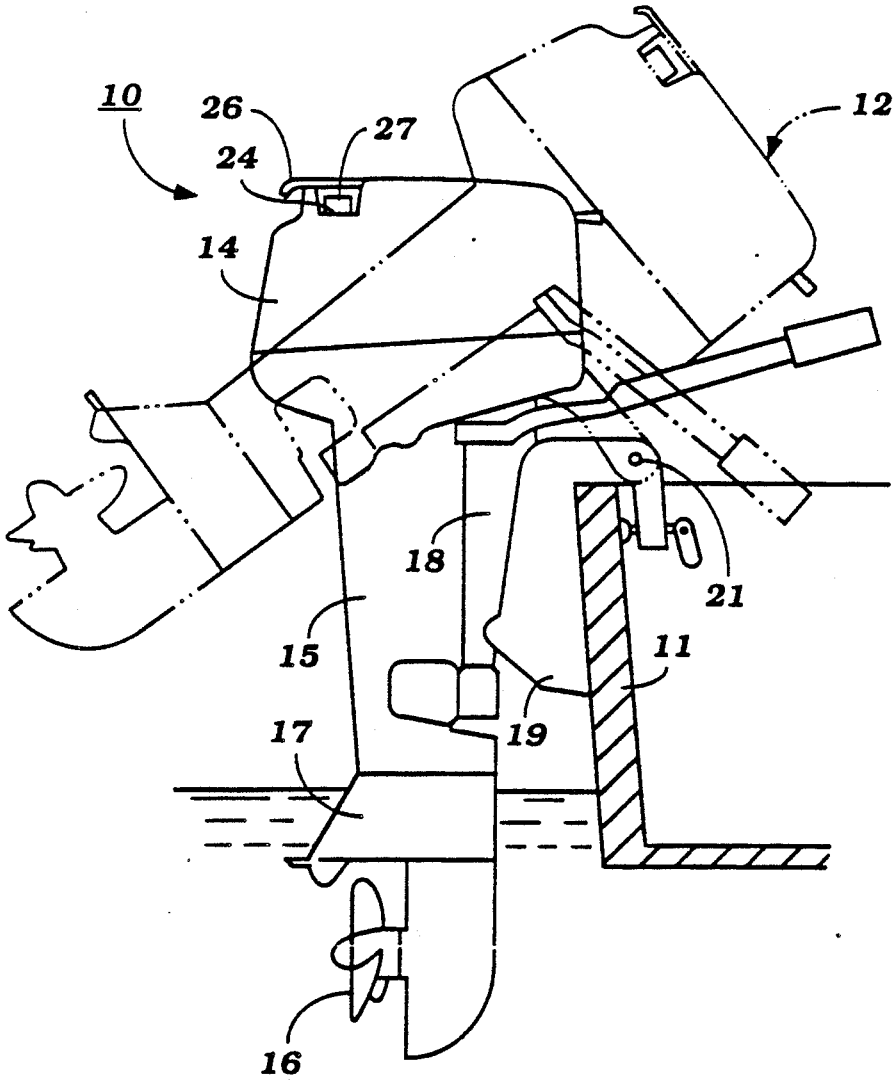
FIG. 1 is a side elevational view of an outboard motor constructed in accordance with this invention.
Figure 2:
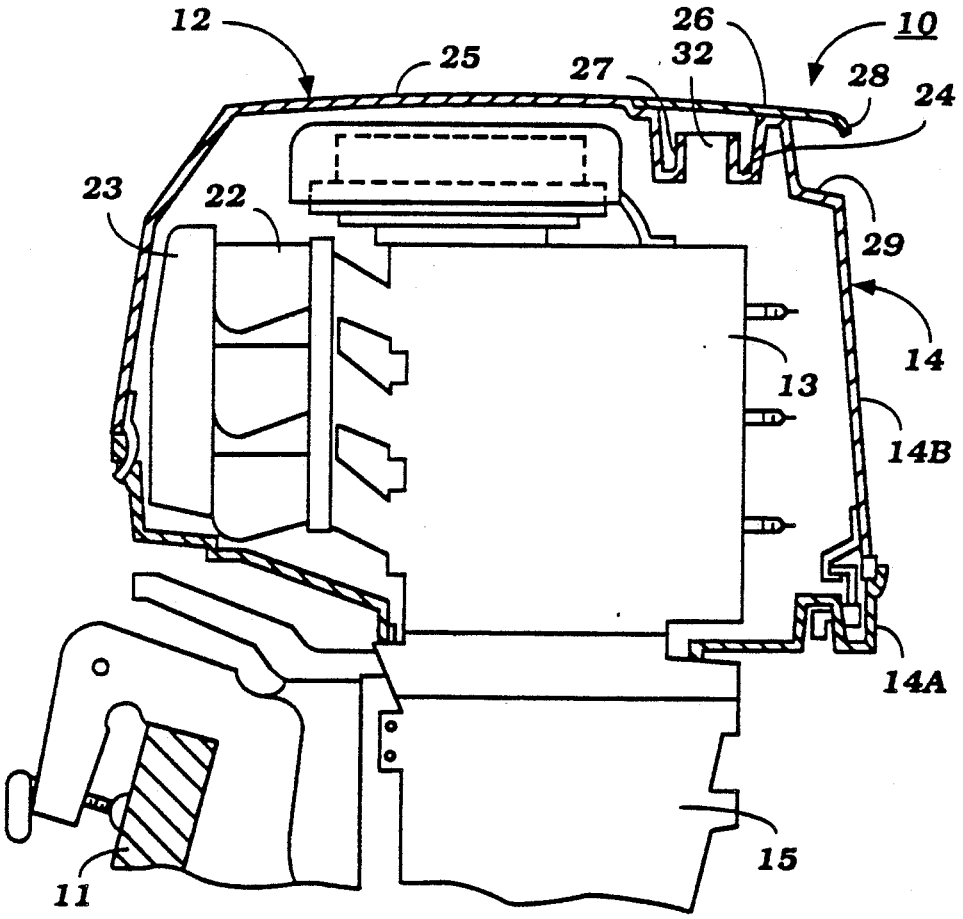
FIG. 2 is an enlarged cross sectional view of the power head of the outboard motor showing components of a first embodiment of the cowling and air inlet device.
Figure 3:
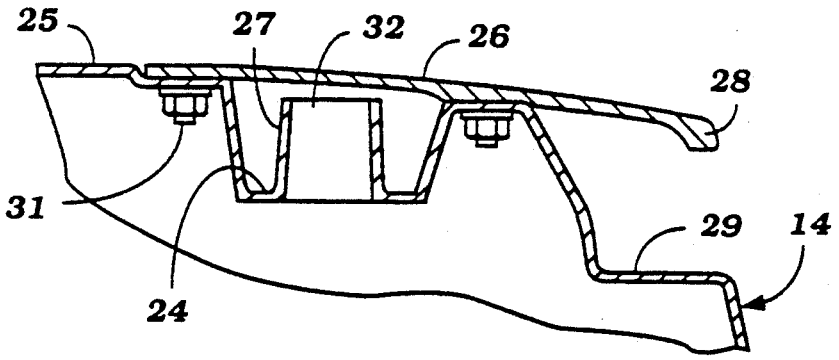
FIG. 3 is an enlarged cross sectional view showing the details of a first embodiment of the cowling and air inlet device.
Figure 4:
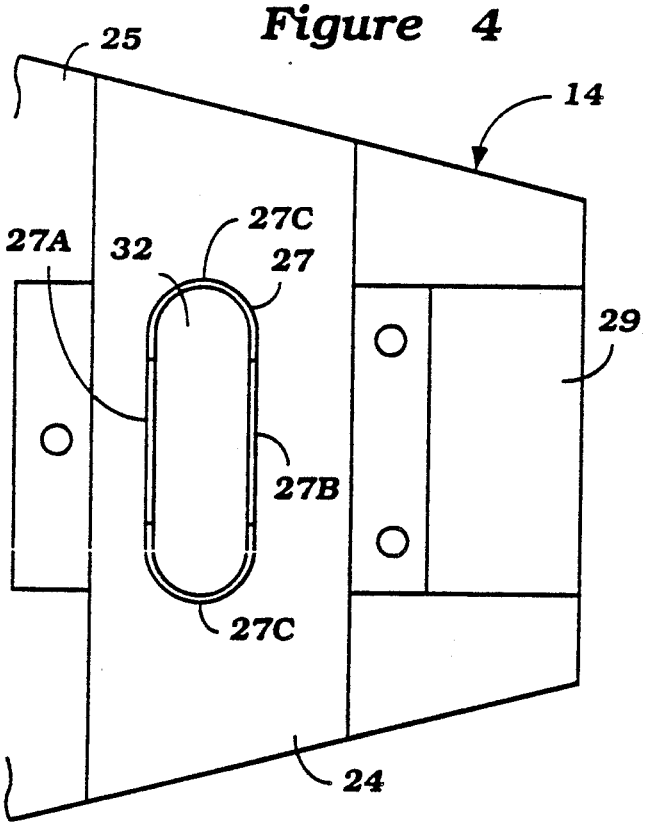
FIG. 4 is a top view of FIG. 3 without the duct cover.
Figure 5:
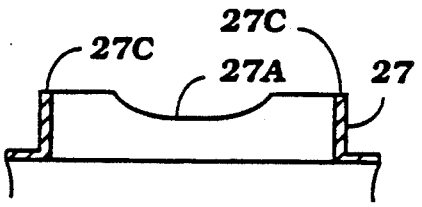
FIG. 5 is a cross sectional plan view showing the air intake duct.
Figure 6:
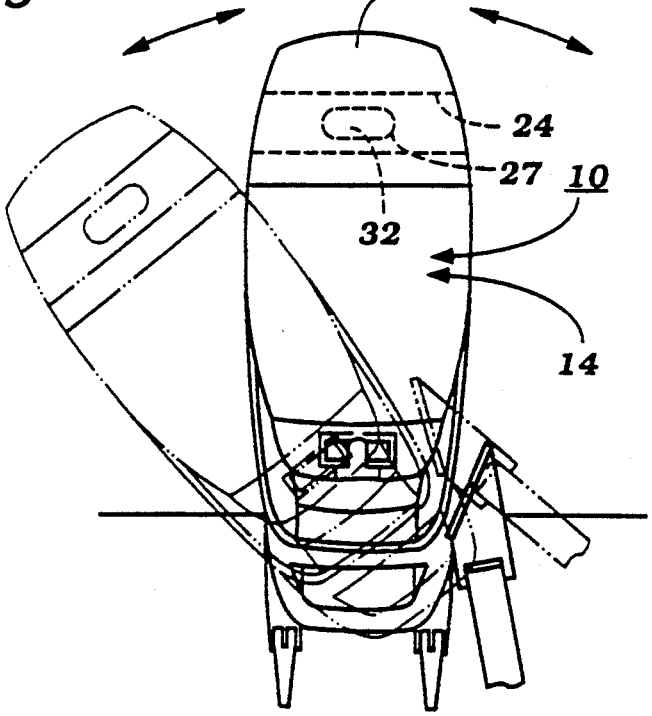
FIG. 6 is a top frontal view showing an outboard motor equipped for steering movement and in an tilted up position.

Referring first to FIG. 1, an outboard motor constructed in accordance with an embodiment of the invention is identified generally by the reference numeral 10 and is shown as attached to a transom 11 of an associated watercraft. The outboard motor 10 includes a powerhead, indicated generally by the reference numeral 12, that contains an internal combustion engine 13 (see FIG. 2) and which is surrounded by a protective cowling 14 and air inlet device constructed in accordance with a first embodiment of the invention. The internal combustion engine 13 drives an output shaft which, in turn, drives a driveshaft that is journalled for rotation within a driveshaft housing 15 that depends from the power head 12. This driveshaft (not shown) drives a propeller 16 of a lower unit 17 by means of a conventional forward, reverse, neutral transmission (not shown).

A steering shaft is affixed to the driveshaft housing 15 in a known manner and is supported for steering movement about a generally vertically extending steering axis within a swivel bracket assembly 18. The swivel bracket assembly 18 is, in turn, pivotally connected to a clamping bracket 19 by means of a tilt shaft 21 for tilt and trim movement of the outboard motor 10. The clamping bracket 19 includes means for affixing the outboard motor 10 to the transom 11 of the watercraft. The construction of the outboard motor 10 as thus far described ma be considered conventional and, for that reason, those components which are not illustrated and which have not been described in any more detail may take the form of any of the known components used in this field.

Referring now in detail to the remaining figures of this embodiment (FIGS. 2 through 6), the protective cowling 14 of the powerhead 12 is comprised of a tray 14A that is affixed to the lower end of the internal combustion engine 13 and a top cover indicated generally by the reference numeral 14B and typically formed from a lightweight plastic material. The top cover 14B has a generally inverted cup shape and carries a pair of latch keepers that are formed at the lower end thereof for cooperation with releasable latch mechanisms carried by the tray 14A for detachably affixing the top cover 14B and tray 14A to each other. When so affixed, this top cover 14B defines a cavity in which the internal combustion engine 13 and its associated parts including carburetors 22 and an air intake device 23 are contained.

The engine 13 contained within the cavity includes an induction system and air must be supplied to this induction system through a suitable inlet since the top cover 14B generally fully encloses the internal combustion engine 13. There is, therefore, formed air inlet means 24 in an upper rear surface of the top cover 14B defining openings on both sides only of the top cover 14B of cowling 14. The air inlet means 24 has sufficient flow area so as to adequately serve the induction system needs of the internal combustion engine 13 of the powerhead 12.

The top cover 14B includes a top member 25 also formed from a lightweight plastic material which defines the top portion of the top cover 14B. A duct cover 26 is secured to the top member 25 by bolts 31 or other suitable means. The cover 26 covers an air intake duct 27 formed within the air inlet means 24 and is positioned upward of the air intake duct 27 and spaced therefrom to cooperate in defining a flow path for air through the air inlet means 24 to the air intake duct 27. The duct cover 26 includes a handle 28 which extends over a recess 29 formed within the upper rear surface of the cowling 14 for grasping the handle 28. The handle 28 is used for tilting up the outboard motor 10.

The air intake duct 27 is mounted on the base of the air inlet means 24, and includes front and rear portions 27A and 27B respectively, and two side portions 27C which cooperatively define an air intake opening 32 for supplying air to the induction system of the internal combustion engine 13. The front and rear portions 27A and 27B have oppositely facing notches at the top thereof, making the front and rear portions 27A and 27B lower in height in the area of the notches than the side portions 27C. The higher side portions 27C serve to further prevent water from entering their intake opening 32, while the lower front and rear portions 27A and 27B increase the air inducing capacity of the air intake duct 27.

By providing air inlet means 24 with openings only on the sides of the cowling 14 and not on the rear of the cowling 14, this invention prevents water from entering the interior of the cowling 14 when a wave strikes the back of the outboard motor 10 and watercraft, which typically results from rapid deceleration of the watercraft. This arrangement also prevents rain from entering the interior of the cowling 14 when the outboard motor 10 is in the tilted up and straight ahead position, as shown in solid lines in FIG. 6. Moreover, when air inlet means 24 with openings on both sides of the cowling 14 are provided, any rain which enters through one side opening when the motor 10 is tilted up and rotated to the side, exits through the other side opening, without entering the interior of the cowling 14.

Figure 7:
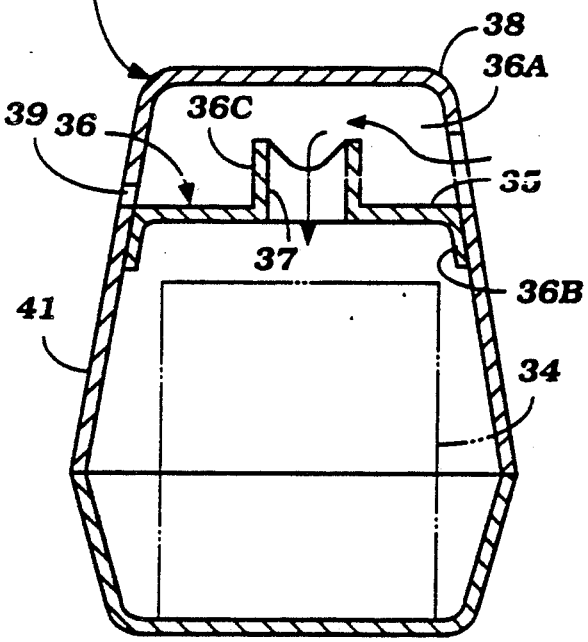
FIG. 7 is a cross sectional plan view of the power head of an outboard motor showing a second embodiment of this invention.
Figure 8:
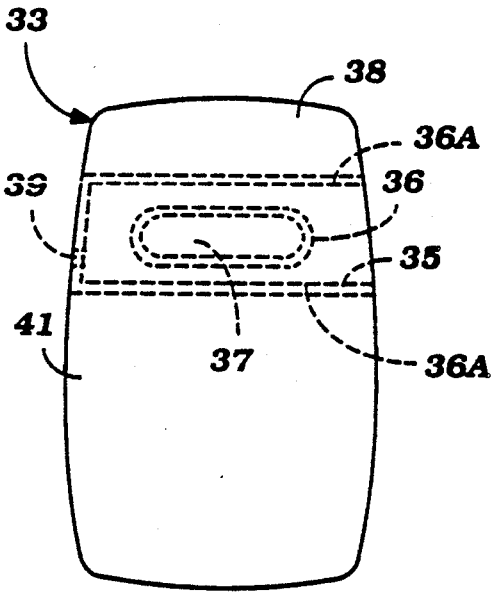
FIG. 8 is a top view of FIG. 7.

FIGS. 7 and 8 show a second embodiment of the invention which is generally similar to the previously described embodiment. A protective cowling 33 is provided including a top cover 41 for enclosing an internal combustion engine 34. In this embodiment, however, the air inlet means 35 is defined on the bottom by a plate 36 comprised of a partition 36A which has adhesional portions 36B extending downwardly from the edge of the plate 36 for securing the plate 36 to the interior walls of the cowling 33. Formed in the middle of the plate 36 approximately equidistant from both sides of the cowling 33 is a air intake duct 36C. As in the first embodiment, the air intake duct 36C includes front and rear portions and two side portions which cooperatively define an air intake opening 37 for supplying air to the engine induction system. The front and rear portions have oppositely facing notches at the top thereof to increase the air inducing capacity of the air intake duct 36C. The higher side portions further prevent water from entering the air intake opening 37.

In this embodiment the duct cover 38 which covers the air intake duct 36C and prevents foreign objects from falling therein is formed within the body of the top cover 41 of the cowling 33. In addition, the air inlet means 35 has a weep hole 39 or small opening on one side of the cowling 33 and a larger opening on the other side.

It should be readily apparent from the foregoing description that two embodiments of the invention have been illustrated and described, each of which is highly effective in providing adequate air flow for the internal combustion engine without the likelihood of water entering the engine induction system or the cavity which surrounds the engine. Although two embodiments of the invention have been illustrated and described, various changes and modifications may be made without departing from the spirit and scope of the invention, as defined by the appended claims.

We claim:

1. A cowling and air inlet device for the powerhead of an outboard motor having an internal combustion engine including an induction system, comprising air inlet means for inducting air from the atmosphere formed in an upper rear surface of said cowling and open only on at least one side of said cowling, air intake means formed within said air inlet means for supplying air to said induction system, and a cover secured to said cowling for covering said air intake means, said cover being positioned upward of said air intake means and spaced therefrom to cooperate in defining a flow path for air through said air inlet means to said air intake means, the upper rear surface of said cowling having a recess formed therein rearwardly of said air inlet means, said cowling having a wall portion separating said air inlet means from said recess and said cover including a handle extending over the recess for grasping of the handle.

2. A cowling and air inlet device as recited in claim 1, wherein said air inlet means comprises a base and said air intake means comprises an air intake duct mounted on said base.

3. A cowling and air inlet device as recited in claim 2, wherein said air intake duct includes front and rear portions and two side portions defining an opening for supplying air to said induction system, said front and rear portions each having oppositely facing notches at the top thereof.

4. A cowling and air inlet device as recited in claim 1, wherein said air inlet means has openings only on both sides of said cowling.

5. A cowling and air inlet device as recited in claim 4, wherein said air inlet means comprises a base and said air intake means comprises an air intake duct mounted on said base.

6. A cowling and air inlet device as recited in claim 5, wherein said air intake duct includes front and rear portions and two side portions defining an opening for supplying air to said induction system, said front and rear portions each having opposite facing notches at the top thereof.

7. A cowling and air inlet device for the power head of an outboard motor having an internal combustion engine including an induction system, comprising air inlet means for inducting air from the atmosphere formed in an upper rear surface of said cowling and open only on both sides of said cowling, air intake means formed within said air inlet means for supplying air to said induction system and a cover for covering said air intake means, said cover being positioned upward of said air intake means and spaced therefrom to cooperate in defining a flow path for air through said air inlet means to said air intake means, the upper rear surface of said cowling having a recess formed therein rearwardly of said air inlet means, said cowling having a wall portion separating said air inlet means from said recess and said cover including a handle extending over the recess for grasping of the handle.

8. A cowling and air inlet device as recited in claim 7, wherein said air inlet means comprises a plate having adhesional portions on the edge thereof for securing said plate to said cowling and said air intake means further comprises an air intake duct.

9. A cowling and air inlet device as recited in claim 8, wherein said air intake duct includes front and rear portions and two side portions which define an opening for supplying air to said induction system, said front and rear portions each having oppositely facing notches at the top thereof.

10. A cowling and air inlet device as recited in claim 9, wherein one of the openings of said air inlet means is a weep hole.

11. A cowling and air inlet device as recited in claim 10, where said cover is part of said cowling.

* * * * *